US007066827B2

(12) United States Patent
Stringer

(10) Patent No.: US 7,066,827 B2
(45) Date of Patent: Jun. 27, 2006

(54) GOLF TRAINING APPARATUS

(76) Inventor: Kevin Lamar Stringer, 7924 Inishmore Way, Indianapolis, IN (US) 46214

( * ) Notice: Subject to any disclaimer, the term of this patent is extended or adjusted under 35 U.S.C. 154(b) by 0 days.

(21) Appl. No.: 10/906,206

(22) Filed: Feb. 9, 2005

(65) Prior Publication Data

US 2005/0239568 A1 Oct. 27, 2005

Related U.S. Application Data

(60) Provisional application No. 60/521,040, filed on Feb. 10, 2004.

(51) Int. Cl.
*A63B 69/36* (2006.01)

(52) U.S. Cl. ..... 473/270; 473/272

(58) Field of Classification Search ..... 473/218, 473/270, 272, 273
See application file for complete search history.

(56) References Cited

U.S. PATENT DOCUMENTS 1,922,130 A * 8/1933 Haserodt ..... 33/508
2,150,580 A * 3/1939 Crowley ..... 473/273
2,777,697 A * 1/1957 Crossot ..... 473/218
4,257,608 A * 3/1981 Funk ..... 473/272
4,384,718 A * 5/1983 Cachola ..... 473/218
4,718,674 A * 1/1988 Henry ..... 473/218
5,108,106 A * 4/1992 Cook ..... 473/272
5,527,041 A * 6/1996 Terry et al. ..... 473/150
5,944,613 A * 8/1999 Dubois ..... 473/218
5,951,409 A * 9/1999 Calley ..... 473/218
6,440,004 B1 * 8/2002 Rodriguez ..... 473/218
6,723,003 B1 * 4/2004 Harrell ..... 473/270

* cited by examiner

*Primary Examiner*—Nini F. Legesse
(74) *Attorney, Agent, or Firm*—Gary M. Hartman; Domenica N. S. Hartman; Hartman & Hartman

(57) ABSTRACT

A golf training apparatus to help golfers hit a golf ball more effectively and consistently. The apparatus includes a base with first markings along a first edge thereof to indicate positions for locating a golfer's feet adjacent the base, and second markings along an oppositely-disposed second edge of the base for indicating the location of a golf ball relative to the base. The apparatus further has an alignment member mounted for movement relative to the base and configured for selective alignment with any one of the second markings. A measuring member is mounted to the alignment member for measuring the distance between the base and the golf ball, and a light-generating device is mounted to the base for illuminating the golf ball.

20 Claims, 3 Drawing Sheets

GOLF TRAINING APPARATUS

CROSS REFERENCE TO RELATED APPLICATIONS

This application claims the benefit of U.S. Provisional Application No. 60/521,040, filed Feb. 10, 2004.

BACKGROUND OF THE INVENTION

The present invention generally relates to golf training techniques and apparatuses. More particularly, this invention relates to an apparatus for training golfers to hit a golf ball more effectively and consistently by tracking where the ball is located relative to the golfer's stance.

Numerous instructional materials and golf training aids are commercially available. The more popular golf training aids and devices typically focus on improving the golfer's swing. For example, U.S. Pat. No. 5,860,871 to Marley, Jr. discloses a golf training device that utilizes lasers for aiding a golfer in developing a more consistent swing. Many golf professionals believe that a proper stance relative to the location of the ball is essential to an effective golf game. While videos, books, and magazine articles offer tips and suggest practice drills for various aspects of the game, few discuss with any specificity where and how a golfer should stand relative to the ball. However, a limited number of training devices have been proposed for this purpose. For example, U.S. Pat. No. 1,922,130 to Haserodt, U.S. Pat. No. 4,257,608 to Funk, U.S. Pat. No. 4,384,718 to Cachola, and U.S. Pat. No. 5,944,613 to Dubois disclose devices having marks or other indicators for positioning a golfer's feet along the edge of a base, and a ruler that extends perpendicularly from the base to indicate the distance of a golf ball from the base. U.S. Pat. No. 3,459,429 to Green discloses a device comprising a base equipped with a tape measure adapted to extend in a direction perpendicular to the base in order to locate the distance of a golf ball from the base. Finally, U.S. Pat. No. 5,616,085 to LaCoste, Jr. et al. discloses a device having a base, an arm that is perpendicular to the base and can be positioned for alignment with a golf ball, and indicators on the base to indicate the position of the ball relative to the base.

It would be desirable if an improved apparatus and system were available for training a golfer to develop a good stance, and particularly to develop a consistent stance relative to the position of the ball.

BRIEF SUMMARY OF THE INVENTION

The present invention provides a golf training apparatus to help golfers hit a golf ball more effectively and consistently. The apparatus includes a base with first markings along a first edge thereof to indicate positions for locating a golfer's feet adjacent the base, and second markings along an oppositely-disposed second edge of the base for indicating the location of a golf ball relative to the base. The apparatus further has an alignment member mounted for movement relative to the base and configured for selective alignment with any one of the second markings. A measuring member is mounted to the alignment member for measuring the distance between the base and the golf ball, and a light-generating device is mounted to the base for illuminating the location of the golf ball.

In use, the apparatus enables a golfer to track where his or her feet are positioned relative to each other, where the ball is located relative to the golfer's feet (the golfer's stance), and the distance the ball is located from the golfer's stance. In this manner, beginning and experienced golfers can determine the most effective ball-to-stance position using a trial-and-error procedure, at the conclusion of which the above factors are recorded on a worksheet to describe an optimum ball-to-stance relationship. This procedure is preferably repeated for each of the golfer's clubs. Thereafter, the golfer can practice driving and putting balls using the optimum ball-to-stance position to develop a more consistent stance that will help the golfer hit the ball more effectively and consistently.

Other objects and advantages of this invention will be better appreciated from the following detailed description.

DETAILED DESCRIPTION OF THE INVENTION

Figure 1:
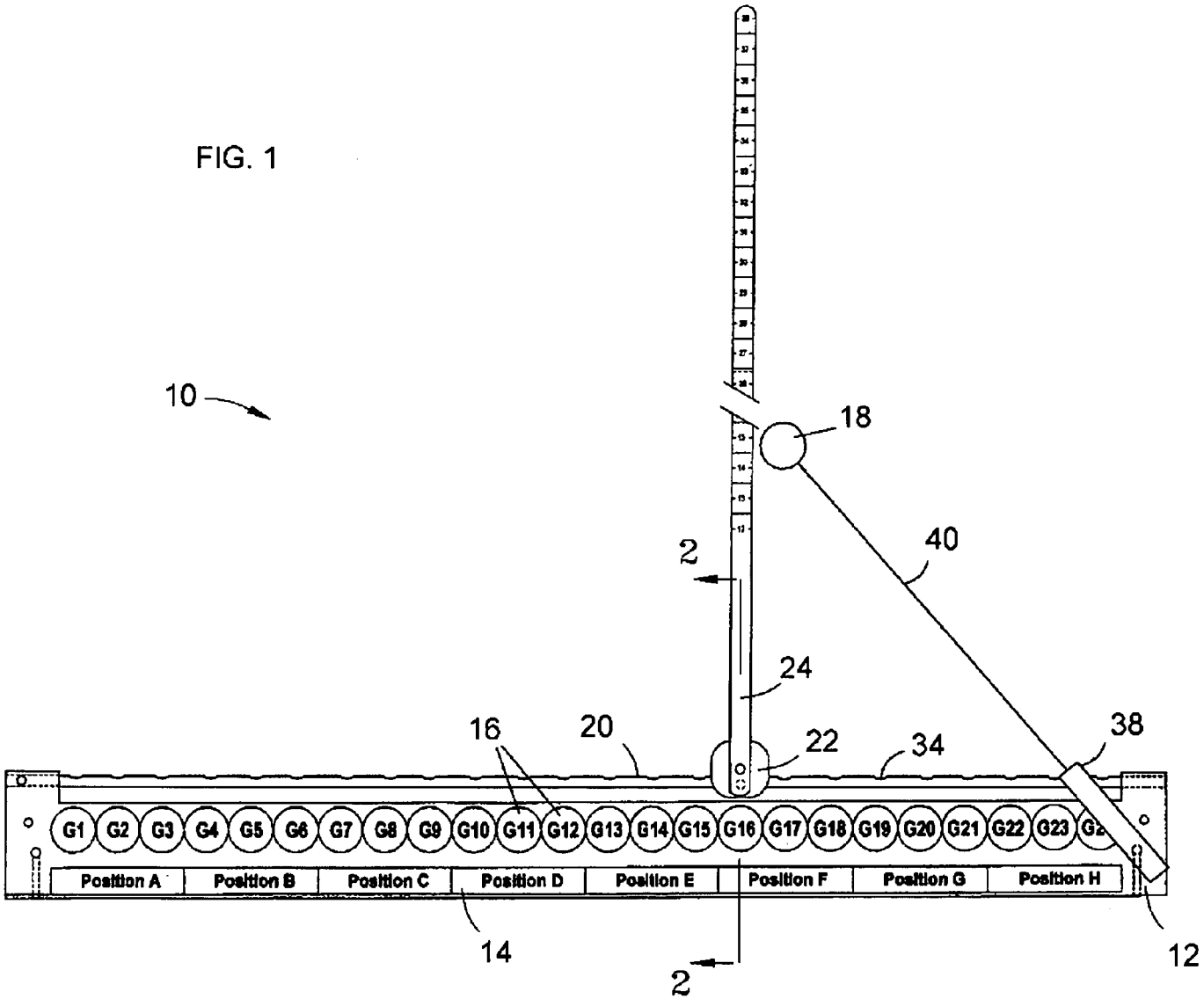
FIG. 1 is a plan view of a golf training apparatus in accordance with a preferred embodiment of this invention.
Figure 2:
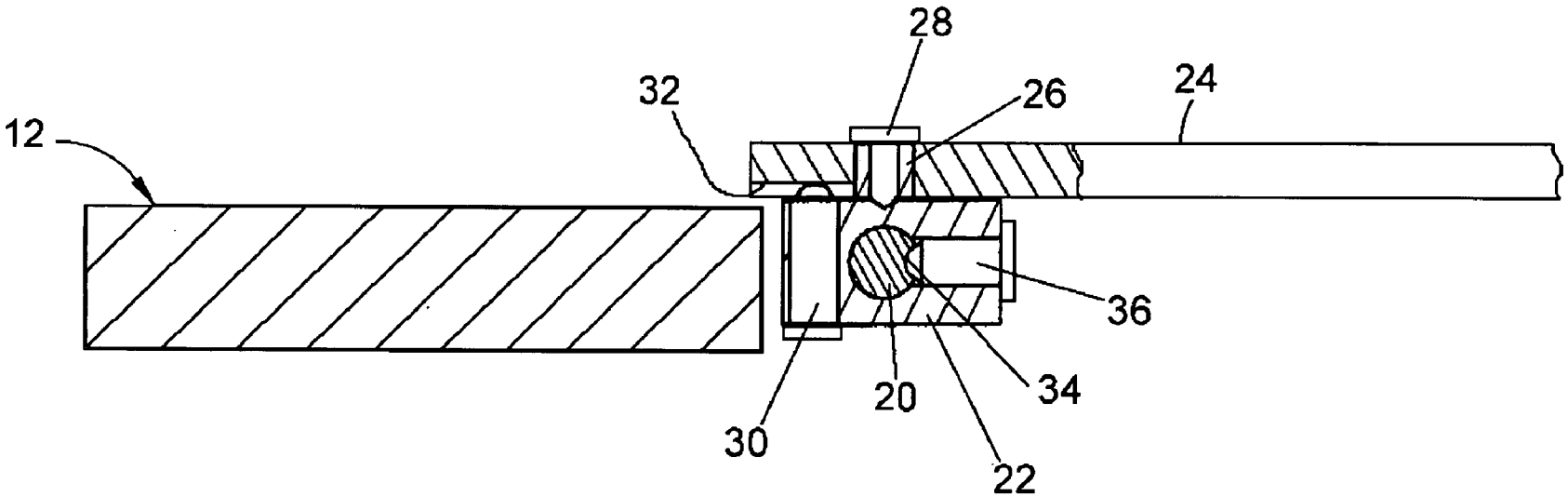
FIG. 2 represents a fragmentary cross-sectional view of the apparatus along line 2—2 of FIG. 1.

Illustrated in FIGS. 1 and 2 is a golf training device 10 in accordance with a preferred embodiment of the present invention. The apparatus 10 is shown as including a base 12 with two parallel rows of markings 14 and 16 located along oppositely-disposed edges of the base 12. The first row of markings 14 is used to locate a golfer's feet relative to the base 12 when hitting a golf ball 18 with a golf club (not shown). The second row of markings 16 is used to locate the golf ball 18 relative to the base 12, and therefore also relative to the golfer's feet and stance. The base 12 is shown as having a rectangular shape, though other shapes are possible. The first row of markings 14 are depicted as boxes that are imprinted or otherwise formed on the base 12. In FIG. 1, the leftmost box is labeled "Position A," and the remaining boxes are in alphabetical order through the rightmost box labeled "Position H." A right-handed golfer may place his/her left foot on any of the boxes, such as the box labeled "Position A," and then place his/her right foot on whichever box is believed to provide a proper stance. A left-handed golfer might place his/her left foot on the box labeled "Position H," and then place his/her left foot on whichever box is believed to provide a proper stance. The golfer can then note his/her stance by observing the letters of the boxes on which his/her feet are placed. Because the second row of markings 16 is used to locate the golf ball 18 relative to the golfer's feet (as described in further detail below), and the normal golf stance is to place the forward and rearward feet ahead and behind the ball 18, respectively, the row of second markings 16 is not required to extend beyond the row of first markings 14.

To locate the ball 18 relative to the base 12 and therefore relative to the golfer's stance, the apparatus 10 is shown as including a rod 20 mounted to the base 12 adjacent the second row of markings 16, and a block 22 slidably mounted to the rod 20. A bar 24 is pivotably mounted to the block 22 and has graduated distance markings or other suitable scale along its length to enable measurement of the position of the ball 18 from the base 12 or its edge. As most readily seen in FIG. 2, the block 22 has an upward-projecting post 26 to which one end of the bar 24 is secured with a fastener 28 to enable the bar 24 to pivot relative to the block 22, and therefore relative to the base 12. The block 22 is equipped with a ball plunger 30 biased in an upward direction so that, when the bar 24 is oriented perpendicular to the near edge of the base 12 (as seen in FIG. 1), the ball plunger 30 engages a channel or recess 32 on the lower surface of the bar 24. In this manner, the bar 24 can be detained in the perpendicular position during use of the apparatus 10, and then stowed in a position over and parallel to the rod 20 when not in use.

The second row of markings 16 are shown as circular symbols having essentially the same size (diameter) and shape of the golf ball 18. The individual markings 16 are numbered consecutively from G1 through G24, and serve to locate the ball 18 relative to the base 12 and therefore the golfer's stance. The block 22 is preferably able to freely move along the length of the rod 20. In the preferred embodiment, the rod 20 is formed to have notches 34 along its length, preferably individually aligned with the markings 16 as shown in FIG. 1. The notches 34 are selectively engagable by a second ball plunger 36 installed in the block 22. In this manner, the block 22, along with the bar 24 mounted thereto and detained perpendicular to the row of markings 16, can be slid along the length of the rod 20 until the bar 24 is positioned adjacent the ball 18 and the block 22 is detained at one of the markings 16.

The apparatus 10 is further shown in FIG. 1 as being equipped with a laser generator 38. The laser generator 38 can be of any commercially available type that can generate a beam 40 capable of illuminating the location of the ball 18 relative to the base 12. The generator 38 is preferably pivotably mounted to the base 12, such as with a post (not shown), to allow for different locations of the ball 18 relative to the base 12. The laser generator 38 can have multiple operating modes, one being a continuous mode in which the beam 40 is continuously generated to illuminate the ball 18 and/or the surface beneath the ball 18. Another operating mode permits the golfer to selectively illuminate the ball 18 (or the surface beneath) by operating a switch or button (not shown). After the golfer hits the ball 18, the laser generator 38 enables the golfer to place a second ball in the same location as the first. The laser generator 38 can be configured to have an alphanumeric position indicator (not shown) to allow the golfer to note and record the position of the generator 38 corresponding to the location of the ball 18.

Figure 3:
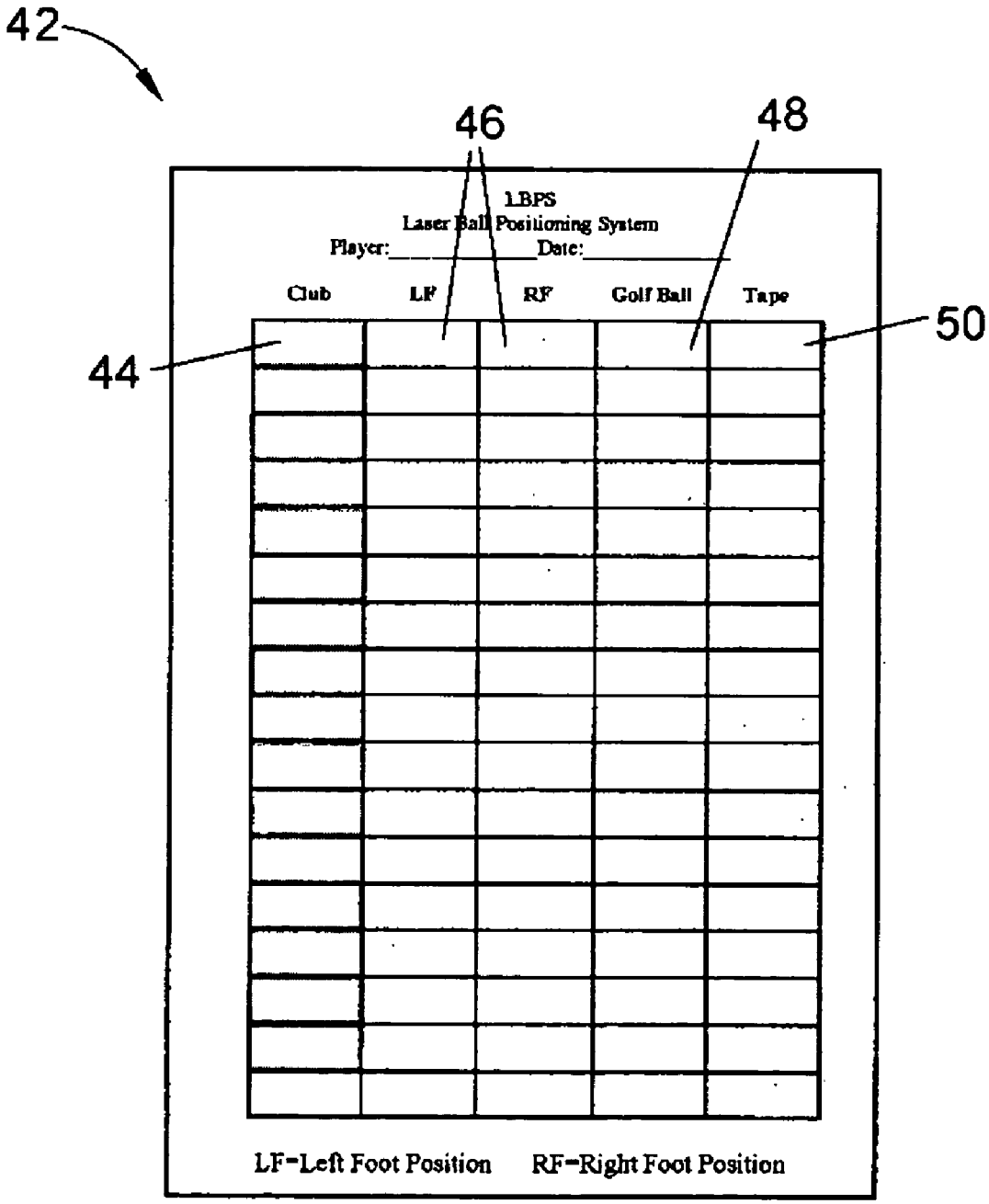
FIG. 3 shows a worksheet for use with the apparatus of FIG. 1.

FIG. 3 shows a worksheet 42 for recording the positional information provided by the apparatus 10 of this invention. In particular, the worksheet 42 includes a column 44 by which the particular club is identified, columns 46 identifying the placement of the golfer's left and right feet (using the markings 14), a column 48 identifying the location of the golf ball 18 along the length of the base 12 (using the markings 16), and a column 50 identifying the distance of the golf ball 18 from the base 12 (using the bar 24).

In use, the golfer places the apparatus 10 on the ground, takes an appropriate stance facing the apparatus 10 with his or her feet aligned with two of the markings 14, and places the ball 18 on the ground or a tee at a location that the golfer believes is suitable for the golfer's stance and the club that will be used. The golfer then rotates the measuring bar 24 into position next to the ball 18, notes the location of the ball 18 with the scale on the bar 24, and illuminates the location of the ball 18 with the laser beam 40. The golfer can then rotate the bar 24 out of the way, strike the ball 18, and decide whether the ball 18 was hit successfully. The laser generator 38 can be used to identically place additional balls 18 without use of the bar 24. If the golfer decides a different ball-to-stance should be attempted, the golfer can play a ball 18 placed in a different location than the previous. Once the golfer feels that one or more balls have been hit successfully, the readings for the successful strike(s) can be recorded on the worksheet 42 and later used to practice hitting any number of balls using essentially the identical ball-to-stance position. This process is preferably repeated for every club used by the golfer.

As described above, the apparatus 10 of this invention can be seen to enable measurement of a number of factors that determine a golfer's stance relative to the ball 18. The apparatus 10 achieves this advantage without encumbering a golfer's ability to swing. For example, the base 12 can have a very low profile, such as a width of about 3.25 inches (about 8 cm) and a length of about 53 inches (about 135 cm), and a thickness of about ¾ inch (about 2 cm). As such, the base 12 can be sized to fit neatly in front of one's feet.

While the invention has been described in terms of a preferred embodiment, it is apparent that other forms could be adopted by one skilled in the art. For example, the physical configuration of the apparatus 10 could differ from that shown, such as that shown in U.S. Provisional Application No. 60/521,040, whose contents are incorporated herein by reference. Therefore, the scope of the invention is to be limited only by the following claims.

What is claimed is:

1. A golf training apparatus comprising:

a base with first markings along a first edge thereof to indicate positions for locating each of a golfer's feet adjacent the base, and second markings along an oppositely-disposed second edge of the base for indicating the location of a golf ball at rest a distance from the base that is sufficient to enable the golfer to strike the golf ball while the golfer's feet are positioned at the first markings along the first edge of the base;

an alignment member mounted for movement relative to the base and configured for selective alignment with any one of the second markings;

means mounted to the alignment member for measuring the distance between the base and the golf ball at the location thereof; and means mounted to the base for illuminating the location of the golf ball with a light beam and enabling the golf ball to be moved and a second golf ball placed at the location the distance from the base.

2. The golf training apparatus according to claim 1, wherein the measuring means is pivotably mounted to the alignment member.

3. The golf training apparatus according to claim 2, wherein the measuring means has a recess and the alignment member comprises means for engaging the recess as the measuring means is pivoted into a position relative to the base.

4. The golf training apparatus according to claim 3, wherein the recess of the measuring means and the engaging means of the alignment member cooperate to detain the measuring means at a position perpendicular to the second edge of the base.

5. The golf training apparatus according to claim 1, further comprising a rod mounted to the base, the alignment member being slidably mounted to the rod.

6. The golf training apparatus according to claim 5, wherein the rod has notches along a length thereof, the notches being individually aligned with the second markings of the base.

7. The golf training apparatus according to claim 6, wherein the alignment member comprises means for engaging any one of the notches of the rod as the alignment member is slid along the length of the rod so as to detain the alignment member at any one of the notches on the rod.

8. The golf training apparatus according to claim 1, wherein the first and second markings define first and second rows, respectively, that are parallel to each other, the row defined by the second markings not extending beyond the row defined by the first markings.

9. The golf training apparatus according to claim 1, wherein the second markings comprise a plurality of circular symbols along the second edge of the base, each of the circular symbols having a diameter approximately equal to the diameter of the golf ball.

10. The golf training apparatus according to claim 9, wherein the plurality of circular symbols are consecutively numbered along the second edge of the base.

11. The golf training apparatus according to claim 1, wherein the measuring means comprises a linear member with graduated distance markings along a length thereof, a first end of the linear member being pivotably mounted to the alignment member.

12. The golf training apparatus according to claim 1, wherein the illuminating means is pivotably supported on the base to enable illumination of the location of the golf ball anywhere along the length of the measuring means.

13. The golf training apparatus according to claim 1, wherein the illuminating means is a laser generating device.

14. A golf training apparatus comprising:

a base with first markings along a first edge thereof to indicate positions for locating each of a golfer's feet adjacent the base and second markings along an oppositely-disposed second edge of the base for indicating the location of a golf ball relative to the base;

a rod mounted to the base adjacent the second edge thereof;

an alignment member slidably mounted to the rod and configured for selective alignment with any one of the second markings;

a bar having a first end pivotably mounted to the alignment member, the bar having graduated distance markings along a length thereof for measuring the distance between the base and the golf ball at the location thereof;

means for generating a laser light beam, the generating means being pivotably mounted to the base to enable selective illumination of the location of the golf ball; and means for recording the first and second markings and the distance between the base and the golf ball.

15. The golf training apparatus according to claim 14, wherein the bar has a recess and the alignment member comprises means for engaging the recess as the bar is pivoted.

16. The golf training apparatus according to claim 15, wherein the recess of the bar and the engaging means of the alignment member cooperate to detain the bar at a position perpendicular to the second edge of the base.

17. The golf training apparatus according to claim 14, wherein the rod has notches along a length thereof, and the alignment member comprises means for engaging the notches of the rod as the alignment member is moved along the length of the rod so as to selectively detain the alignment member at any one of the notches on the rod.

18. The golf training apparatus according to claim 17, wherein the notches are individually aligned with the second markings of the base.

19. The golf training apparatus according to claim 14, wherein the second markings comprise a plurality of circular symbols along the second edge of the base, each of the circular symbols has a diameter approximately equal to the diameter of the golf ball, and the plurality of circular symbols are consecutively numbered along the second edge of the base.

20. The golf training apparatus according to claim 14, wherein the first and second markings define first and second rows, respectively, that are parallel to each other, the row defined by the second markings not extending beyond the row defined by the first markings.

* * * * *